US005685450A

United States Patent [19]

Uda

[11] Patent Number: 5,685,450

[45] Date of Patent: Nov. 11, 1997

[54] FLEXIBLE CONTAINER AND REINFORCING INSERT THEREFOR

[75] Inventor: Mamoru Uda, St. Charles, Ill.

[73] Assignee: Helios Container Systems, Inc., Bloomingdale, Ill.

[21] Appl. No.: 359,580

[22] Filed: Dec. 20, 1994

[51] Int. Cl.[6] ..... B65D 33/00

[52] U.S. Cl. ..... 220/402; 220/403

[58] Field of Search ..... 220/402, 403

[56] References Cited

U.S. PATENT DOCUMENTS

| | | | |
|---|---|---|---|
| 3,399,818 | 9/1968 | Stegner | 220/403 X |
| 3,915,329 | 10/1975 | Zaks | 220/402 X |
| 4,037,778 | 7/1977 | Boyle . | |
| 4,628,007 | 12/1986 | Ledsham | 220/403 X |
| 4,955,496 | 9/1990 | Nelson | 220/403 X |
| 4,978,028 | 12/1990 | George et al. | 220/403 |
| 5,129,609 | 7/1992 | Tobin | 220/403 X |
| 5,158,369 | 10/1992 | Derby . | |
| 5,323,922 | 6/1994 | Lapoint, Jr. et al. . | |

FOREIGN PATENT DOCUMENTS

| | | |
|---|---|---|
| 360730 | 3/1990 | European Pat. Off. . |
| 2241220 | 8/1991 | United Kingdom . |

*Primary Examiner*—Steven M. Pollard

*Attorney, Agent, or Firm*—Wood, Phillips, VanSanten, Clark & Mortimer

[57] ABSTRACT

A container is provided having a wall bounding a material storage space for a bulk supply of material and an opening through which bulk material can be introduced into the storage space from externally thereof. The wall is formed at least partially from a flexible material that can be reconfigured to vary the configuration of the storage space. A reinforcing insert and a structure cooperating between the reinforcing insert and the container for removably maintaining the flexible container wall in an operative position is provided wherein the reinforcing insert maintains the flexible material in a first predetermined shape to facilitate the introduction of bulk material into the material space.

26 Claims, 1 Drawing Sheet

FLEXIBLE CONTAINER AND REINFORCING INSERT THEREFOR

FIELD OF THE INVENTION

This invention relates to flexible containers having a collapsible wall that bounds a variable storage space and, more particularly, to a reinforcing insert to maintain the wall in a predetermined shape and allow access to the storage space during loading thereof.

BACKGROUND OF THE INVENTION

The use of containers made from collapsible, flexible sheet stack for receipt, storage and transport of bulk supplies of material is known. These containers, which are often made from sewn panels of reinforced plastic, can be constructed at a low cost, yet are highly durable and capable of holding large quantities of heavy particulate material. Due to the flexible nature of the material used for constructing these containers, the flexible containers can be stored and/or transported to a site for use in a collapsed state, thereby realizing significant space savings.

After bulk material has been introduced into the flexible container, the walls of the container can be collapsed around the material therein, again helping to realize potentially significant space savings when material is stored and/or transported in these containers.

One particular application for which the flexible containers are especially adapted is clean-up at industrial waste sites. The filled containers are transported to a landfill where the containers with bulk material therein can be disposed of. Because the containers are inexpensive, their reuse, although possible, is not of significant economic concern.

However, use of such containers also has drawbacks. Generally, the flexible containers are provided with loops of material near the fill opening therein such that, for example, the blades on a forklift can be extended therethrough to support the container and allow for the loading of bulk material into the container. Nevertheless, even when a forklift is used, because the containers are made from flexible materials, during the introduction of bulk or other material into the containers, the container walls need to be regularly attended to to be certain that access to and the configuration of the storage space inside the container is maintained so as to prevent obstruction of the opening and/or an undesirable reconfiguration of the storage space, both of which can occur due to collapse of the flexible walls around the opening and/or the storage space as by movement of the loops on the blades.

The flexible nature of the container is particularly troublesome when loading and either a forklift or the like is unavailable or the container is used on site in an area not accessible to a conventional forklift, i.e., outdoors as in an open field. This may require a user to manually maintain the container walls in a configuration such that the opening of the container is not obstructed. This requires either that the user regularly stop and adjust the container accordingly, or employ another person to accomplish this. Either solution is unsatisfactory in that the former creates delays in the loading of bulk supply or other materials and the latter requires additional manpower, both of which increase the expense associated with this task.

Moreover, even when a forklift is used, this requires that the forklift be dedicated solely to the task of loading the container such that it is precluded from being used to carry out other tasks that may be required of it. Again, this also drives operation costs up as either a second forklift must be used to carry out other tasks during loading or the container or the other tasks must wait until completion of loading, thus creating potential costly delays.

SUMMARY OF THE INVENTION

The present invention is specifically directed to overcoming the above enumerated problems in a novel and simple manner.

In one form of the invention, a combination of a container and reinforcing insert is provided. The container has a wall bounding a material storage space for a bulk supply of material and an opening through which bulk material can be introduced to the storage space from externally thereof. The wall is formed at least partially from a flexible material that can be reconfigured to vary the configuration of the storage space. Structure cooperates between the reinforcing insert and container for maintaining the reinforcing insert in an operative position wherein the reinforcing insert maintains the flexible material in a first predetermined shape to facilitate the introduction of bulk material into the material storage space through the container opening.

The container wall has a peripheral edge around the opening. The reinforcing insert has a wall which extends substantially around the peripheral edge with the reinforcing insert in its operative position.

The container preferably has a collapsed state and an expanded state, with the container opening being smaller with the container in the collapsed state than it is with the container in the expanded state.

The reinforcing insert is at least partially within the material storage space with the reinforcing insert in the operative position.

The reinforcing insert may be removably placed in its operative position or permanently attached to the container.

In one form, the reinforcing insert is maintained in its operative position by frictional forces between the container wall and the wall on the reinforcing insert.

In one form, the wall on the reinforcing insert has first and second oppositely facing wall parts and the first and second wall parts bear simultaneously against the container wall with the reinforcing insert in the operative position.

The reinforcing insert may be made from a flexible material. A stiffener can be used for maintaining a part of the flexible material in a second predetermined shape.

In one form, the stiffener is made from a deformable, shape-retentive material that permits the stiffener and the part of the flexible material to reconfigure under a predetermined force applied thereto from the second predetermined shape and to re-assume the second predetermined shape when the predetermined force applied thereto is removed.

The stiffener can be ring-shaped or may have another shape that can be derived by one skilled in the art with knowledge of the inventive concept.

In one form, the reinforcing insert is defined by a plurality of wall parts including first and second wall parts that can be placed selectively in expanded and collapsed states. In the expanded state, the wall parts may cooperatively define an endless wall, whereas in the collapsed state, the wall parts are stacked one against the other.

The wall parts may be flat.

In one form, there are at least four flat wall parts and two of the flat wall parts have flat surfaces that face each other, with another two of the flat wall parts having flat surfaces that face each other.

In one form, there are at least two layers of flexible material on the reinforcing insert that captively surround the stiffener.

In one form, the reinforcing insert is defined by a plurality of wall parts each having a top, bottom, and spaced side edges. The wall parts are joined edge-to-edge to define a continuous wall, with there being first and second of the wall parts defined by two layers of flexible material that bound a space, and a stiffener provided one each in the spaces in the first and second wall parts.

In one form, the container has a collapsed state and an expanded state and with the container in the expanded state the container wall has a shape that is complementary to the shape of the wall on the reinforcing insert with the reinforcing insert in its expanded state.

The invention further contemplates a method of defining a container into which a supply of bulk material can be introduced. The method includes the steps of providing a container having a flexible wall, as described above, reconfiguring the flexible container wall so that the flexible container wall has a first predetermined shape, providing a separate reinforcing insert as described above, and placing the reinforcing insert inside of the material storage space in the container and placing the reinforcing insert in its expanded state so that the reinforcing insert and container cooperate to at least one of a) maintain the container wall in the first predetermined shape and b) maintained the container opening in an enlarged state.

The method may include the step of placing the reinforcing insert in the collapsed state before placing the reinforcing insert inside of the material storage space.

The method may further include the step of placing material in the storage space after the reinforcing insert is placed in the material storage space.

DETAILED DESCRIPTION OF THE DRAWINGS

Figure 1:
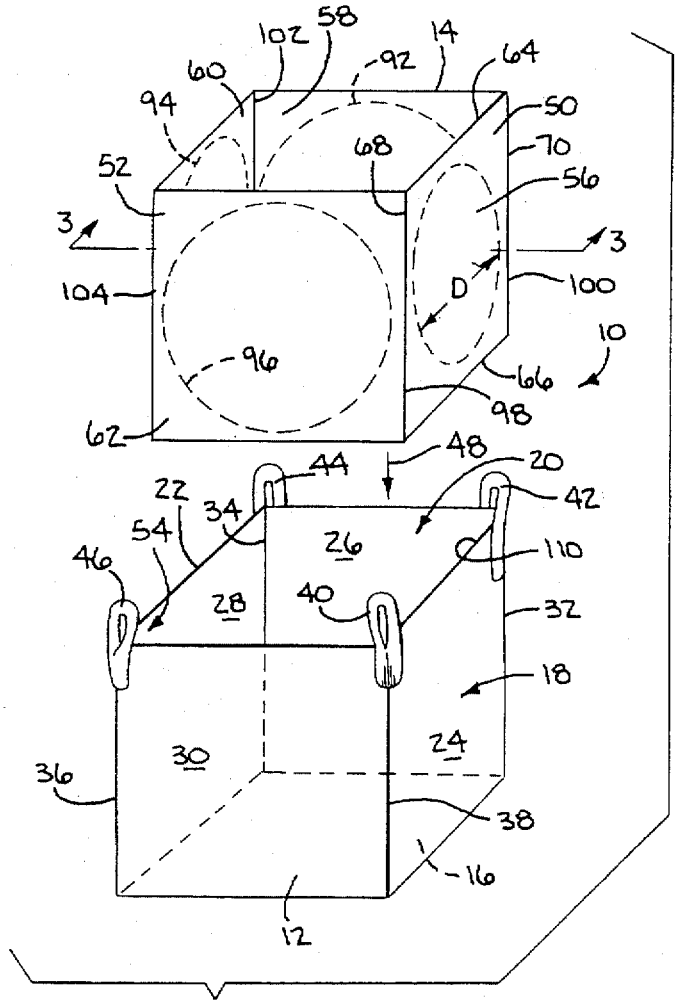
FIG. 1 is an exploded perspective view of a container, that is made at least partially from flexible material, and a reinforcing insert therefor, according to the present invention.

In FIG. 1, a bulk storage system, according to the present invention, is shown at 10. The system 10 consists of a conventional-type, flexible container 12 and an insert 14 which cooperates with the container 12 to maintain the container 12 in a predetermined shape.

More particularly, the container 12 has a squared configuration with a bottom wall 16 and a peripheral wall 18 cooperatively bounding a storage space at 20 for a bulk supply of material. The material storage space 20 is accessed through a top opening 22.

It should be understood that the configuration of the container 12 is intended to be only exemplary in nature. The shape and construction of the container 12 can vary considerably from that shown.

The container 12 shown may be formed from a number of different materials. One typical construction uses a reinforced plastic material to define the peripheral wall 18 and the bottom wall 16.

The container 12 has four wall panels/parts 24, 26, 28, 30 that are joined edge-to-edge to define a continuous wall formation. Typically, these individual panels 24, 26, 28, 30 are sewn together and each to the bottom wall 16.

At the comers 32, 34, 36, 38 defined between adjacent panels 24, 26, 28, 30, lifting loops 40, 42, 44, 46 are sewn. These lifting loops 40, 42, 44, 46 are typically spaced so that one blade of a fork lift (not shown) can be directed through the lifting loops 40, 42 and another blade of the fork lift can be directed through the lifting loops 46, 44 so that the container 12 can be lifted and transported through the use of the fork lift. With the container 12 supported on a fork lift, the top opening 22 on the container 12 is fully enlarged to permit introduction of bulk material into the space 20 from externally thereof.

However, in the absence of any supporting force being applied to the lifting loops 40, 42, 44, 46, the container 12 tends to collapse under its own weight so that the top fill opening 22 is restricted, which inhibits the introduction of bulk material into the space 20.

Figure 8:
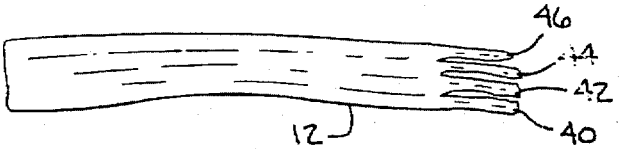
FIG. 8 is a side elevation view of the container in FIG. 1 in a collapsed state.

In most cases, for purposes of transportation, the entire container 12 is collapsed to the state shown in FIG. 8. Once the container 12 is transported on site, the user expands the container 12. This type of container is not shape-retentive and thus it collapses upon itself. In this state, the fill opening 22 can be accessed only by manually spreading the wall parts 24, 26, 28, 30 at the opening 22 each time the material is to be introduced. This is highly inconvenient but has been contended with in order to retain the benefits of the collapsible container 12.

Figure 2:
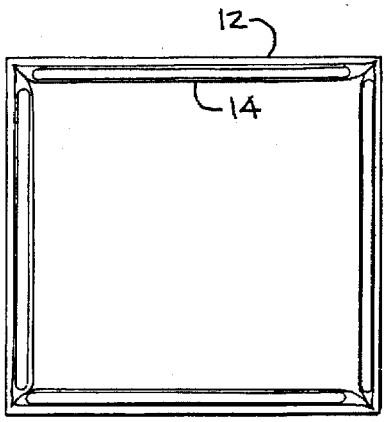
FIG. 2 is a plan view of the inventive reinforcing insert in an operative position within the container.
Figure 3:
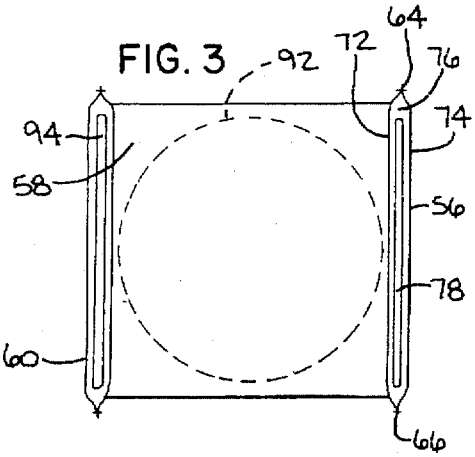
FIG. 3 is a cross-sectional view of the reinforcing insert taken along line 3—3 of FIG. 1.
Figure 5:
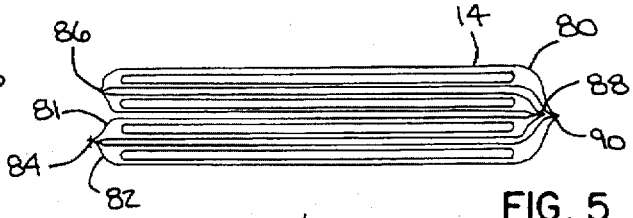
FIG. 5 is a side elevation view of the reinforcing insert in a collapsed state.
Figure 6:
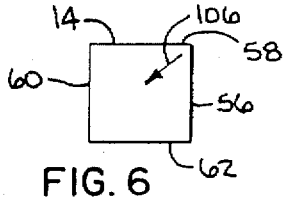
FIG. 6 is a schematic plan view of the reinforcing insert in an expanded state.
Figure 7:
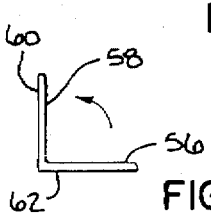
FIG. 7 is a view as in FIG. 6 showing the reinforcing insert in transition between its expanded and collapsed states.

According to the invention, the insert 14 can be directed into the storage space 20 through the top opening 22, in the direction of the arrow 48, into an operative position as shown in FIG. 2. The insert 14 itself is made collapsible to the state shown in FIG. 5 so that transportation thereof separately from the container 12 is facilitated.

The reinforcing insert 14, as seen in FIGS. 1–7, has a wall 50 which, in its expanded state, has a shape that is complementary to the squared shape defined by the wall panels 24, 26, 28, 30 on the container 12. As a result, with the insert 14 in its operative position in the container 12, the outside surface 52 of the insert wall 50 frictionally engages the inside surface 54 defined by the peripheral wall 18 on the container 12.

In a preferred construction, the insert 14 has wall parts 56, 58, 60, 62 which cooperatively define the wall 50. Since each of the wall parts 56, 58, 60, 62 is substantially the same, only exemplary wall part 56 will be described. The wall part 56 is substantially square with a top edge 64, a bottom edge 66, and spaced side edges 68, 70. The wall part 56 is defined by first and second flat sheet layers 72, 74 which are sewn together at the top edge 64, the bottom edge 66 and the side edges 68, 70 to define a chamber/space 76 therebetween.

Within the space 76, a stiffening element 78 is provided. In this case, the stiffening element 78 is in the form of a ring-shaped band having a diameter D that extends approximately fully between the top and bottom edges 64, 66 and the side edges 68, 70. In the event that the distance between the top and bottom of the wall part 56 is different than the distance between the sides thereof, the stiffening element 78 can be made in an oval or elliptical shape. The stiffening element 78 maintains the sheet layers 72, 74 in a stretched, substantially flat state.

To assemble the stiffening element 78, three of the four edges 64, 66, 68, 70 can be sewn, after which the stiffening element 78 can be placed in the space 76. The fourth edge 64, 66, 68, 70 can then be sewn so that the stiffening element 78 is captive in the space 76 between the layers 72, 74.

The entire wall 50 can be formed from a single sheet 80 that can be folded against itself with the free ends 81, 82 joined by a line of stitching 84. The overlapping layers 72, 74 defined by the sheet 80 can be stitched at three additional locations 86, 88, 90 and define the individual chambers/spaces 76 for the three additional stiffening elements 92, 94, 96 associated with the wall parts 58, 60, 62, respectively.

With this arrangement, the vertical lines of stitching at the corners 98, 100, 102, 104 define fold lines about which the adjacent wall parts 56, 58, 60, 62 hinge relative to each other. With this arrangement, and the insert 14 in the expanded state, the walls 56, 58 can be folded inwardly as indicated by the arrow 106 to the FIG. 7 position, whereupon the wall parts 56, 62 can be folded towards the wall parts 58, 60 to realize the collapsed state, shown in FIG. 5, for the insert 14. In the collapsed state, the wall parts 56, 58, 60, 62 are stacked one against the other.

With the inventive structure, the user can separately transport the container 12 and insert 14, each in the collapsed state, to a use site. The insert 14 can then be directed through the fill opening 22 into the storage space 20. This can be accomplished with the insert 14 either in its collapsed state, its expanded state, or some state in between. Once the insert 14 is within the container 12, the insert 14 can be pressed outwardly to place the insert 14 and container 12 both fully in the expanded state, which in this case gives the system an overall square shape. Frictional forces between the container 12 and insert 14 are sufficient that the container 12 and insert 14 become mutually reinforcing.

The wall 50 on the insert 14 extends fully around the top edge 110 of the container 12 to enlarge the top fill opening 22. This allows the user to conveniently direct relatively large size objects into the storage space 20.

The stiffening elements 78, 92, 94, 96, by reason of their annular shape, can be made relatively light in weight while still adequately performing their function of stretching out the sheet material 81 on the wall parts 56, 58, 60, 62. The stiffening elements 78, 92, 94, 96 can be made from metal or a plastic material that will flex yet be shape-retentive.

Figure 4:
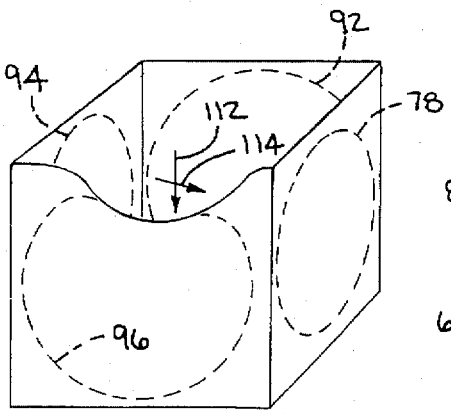
FIG. 4 is a perspective view of the reinforcing insert in its expanded state and with a force being applied thereto to deform the insert.

The flexibility in the stiffening elements 78, 92, 94, 96 is desirable not only from the standpoint of facilitating placement of the insert 14 in the container 12 but also by reason of the fact that it permits the container wall panels 24, 26, 28, 30 to deform with the insert 14 in the operative position in the container 12. As seen in FIG. 4, when a load, such as an object to be placed in the space 20, is dropped upon the top edge 110 of the container 12, as in the direction of the arrow 112, the stiffening element 96 deforms downwardly, as would the cooperating wall panel 30. A force downwardly and inwardly, in the direction of the arrow 114, would also be accommodated by the stiffening element 96 and wall 30 by deformation in the direction of the applied force. Once this force is removed, the wall panel 30 and stiffening element 96 re-assume the undeformed state.

The insert 14 can be made from material that is sufficiently inexpensive that the entire insert 14 can be disposed of with the container 12 and its contents. This is desirable in the event of a cleanup of toxic or otherwise harmful materials. On the other hand, upon discharging other harmless materials from the container 12, the insert 14 could be removed, as to transport it and the container 12 in the collapsed state to another site.

The foregoing disclosure of specific embodiments is intended to be illustrative of the broad concepts comprehended by the invention.

We claim:

1. In combination:

a) a container having a wall bounding a material storage space for a bulk supply of material and an opening through which bulk material can be introduced to the storage space from externally thereof, said wall being formed at least partially from a flexible material that can be reconfigured to vary the configuration of the material storage space;

b) a reinforcing insert having an endless wall comprising first and second wall parts that are joined to each other along a fold line, said wall parts being repositionable relative to each other by folding at the fold line to place the endless wall selectively in a collapsed state and an expanded state; and c) means cooperating between the reinforcing insert and container for maintaining the reinforcing insert in an operative position, wherein the reinforcing insert comprises a flexible material, a stiffener, and means cooperating between the flexible material and stiffener for maintaining a part of the flexible material on the reinforcing insert in a second predetermined shape, wherein the container has a top and bottom, the opening is at the top of the container and the stiffener is ring-shaped and extends around an axis that is transverse to a line forming the central axis of the container with the reinforcing insert in the operative position, wherein with the reinforcing insert in the operative position and in the second predetermined shape, the reinforcing insert maintains the flexible material in a first predetermined shape to facilitate the introduction of bulk material into the material storage space through the container opening.

2. The combination of claim 1 wherein the container wall has a peripheral edge around the opening and the endless wall on the reinforcing insert extends entirely around the peripheral edge with the reinforcing insert in the operative position and in the expanded state.

3. The combination of claim 1 wherein the container has a collapsed state and an expanded state and the container opening is smaller with the container in its collapsed state than it is with the container in its expanded state.

4. The combination of claim 1 wherein the reinforcing insert is at least partially within the material storage space with the reinforcing insert in the operative position.

5. The combination of claim 1 wherein the cooperating means comprises means for removably maintaining the reinforcing insert in the operative position.

6. The combination according to claim 1 wherein the cooperating means comprises means for frictionally engaging the container wall and the wall on the reinforcing insert.

7. The combination according to claim 6 wherein the first and second wall parts bear simultaneously against the container wall with the reinforcing insert in the operative position.

8. The combination according to claim 1 wherein the stiffener is defined by a deformable, shape-retentive material that permits the part of the flexible material on the reinforcing insert to reconfigure under a predetermined force applied thereto from the second predetermined shape and to re-assume the second predetermined shape when the predetermined force applied thereto is removed.

9. The combination according to claim 1 wherein with the endless wall on the reinforcing insert in the collapsed state the first and second wall parts are stacked one against the other.

10. The combination according to claim 9 wherein the wall parts are substantially flat.

11. The combination according to claim 10 wherein there are at least four flat wall parts defining the reinforcing insert and two of the flat wall parts have flat surfaces that face each other and another two of the flat wall parts have flat surfaces that face each other.

12. The combination according to claim 1 wherein there are two layers of flexible material on the reinforcing insert that captively surround the stiffener.

13. The combination according to claim 1 wherein the first and second wall parts are each defined by two layers of flexible material that bound a space and a stiffener is provided one each in the spaces in the first and second wall parts.

14. The combination according to claim 13 wherein the container has a collapsed state and an expanded state and with the container in its expanded state the container wall has a shape that is complementary to the shape of the wall on the reinforcing insert with the reinforcing insert in its expanded state.

15. A reinforcing insert for use with a collapsible container having a flexible wall bounding an interior storage space and an opening through which bulk material can be introduced to the storage space, the reinforcing insert comprising:

a plurality of wall parts; and means cooperating between the plurality of wall parts for allowing the plurality of wall parts to be placed selectively in a) an expanded state wherein the wall parts bound a space within which bulk material can be placed and b) a collapsed state wherein the wall parts occupy less space than the wall parts occupy with the wall parts in the expanded state, said plurality of wall parts in the expanded state having a top and bottom, and a top opening, said plurality of wall parts being foldable relative to each other in a predetermined fashion to change the wall parts between the expanded and collapsed states, at least one of the wall parts comprising a deformable shape-retentive stiffening element that is deformable from a first state downwardly under a predetermined force applied at the top of the at least one wall part to a second state and re-assumes the first state with the predetermined force removed.

16. The reinforcing insert according to claim 15 wherein the wall parts each comprise first and second layers of flexible material between which at least one stiffening element is located.

17. The reinforcing insert according to claim 15 wherein the stiffening element comprises a continuous ring.

18. The reinforcing insert according to claim 17 wherein the continuous ring comprises one of metal and plastic.

19. The reinforcing insert according to claim 17 wherein each continuous ring has a central axis that extends through the space bounded by the wall parts with the wall parts in the expanded state.

20. The reinforcing insert according to claim 15 wherein the wall parts are flat and in the collapsed state the wall parts are stacked against each other.

21. A method of defining a container into which a supply of bulk material can be introduced, said method comprising the steps of:

providing a container having a flexible wall bonding a storage space for a bulk supply of material and a top opening through which bulk material can be introduced to the storage space from externally thereof;

reconfiguring the flexible container wall so that the flexible container wall has a first predetermined shape;

providing a separate reinforcing insert having a wall with wall parts that can be folded relative to each other so that the reinforcing insert can be placed selectively in a) an expanded state wherein the wall parts bound a space within which bulk material can be placed and b) a collapsed state wherein the wall parts occupy less space than the wall parts occupy with the wall parts in the expanded state and a flexible reinforcing element in a part of the endless wall that is deformable downwardly to allow the part of the endless wall to deform downwardly under a predetermined downward force applied thereto and reassume an undeformed state with the predetermined downward force removed; and placing the reinforcing insert in the material storage space in the container at least partially in the collapsed state by folding the wall parts in a predetermined manner relative to each other and after placing the reinforcing insert in the material storage space placing the reinforcing insert in its expanded state so that the reinforcing insert and container cooperate to at least one of a) maintain the container wall in the first predetermined shape and b) maintain the container opening in an enlarged state.

22. The method according to claim 21 including the step of placing material in the storage space after the reinforcing insert is placed in the material storage space.

23. The method of claim 21 wherein the step of providing a reinforcing insert comprises the step of providing a reinforcing insert with a readily deformable shape-retentive stiffening element.

24. The method of claim 23 wherein the container has a top and bottom and including the step of deforming the reinforcing insert towards the bottom of the container by exerting a downward force thereon as bulk material is introduced to the storage space.

25. The combination of claim 1 wherein the reinforcing insert has a top and bottom in the operative position and the reinforcing insert comprises a shape-retentive stiffening element that is deformable under a downward force exerted thereon.

26. A reinforcing insert for use with a collapsible container having a flexible wall bounding an interior storage space and an opening through which bulk material can be introduced to the storage space, the reinforcing insert comprising:

a plurality of wall parts; and means cooperating between the plurality of wall parts for allowing the plurality of wall parts to be placed selectively in a) an expanded state wherein the wall parts bound a space within which bulk material can be placed and b) a collapsed state wherein the wall parts occupy less space than the wall parts occupy with the wall parts in the expanded state, said plurality of wall parts in the expanded state having a top and bottom, and a top opening, at least one of the wall parts comprising a deformable shape-retentive stiffening element that is deformable from a first state downwardly under a predetermined force applied at the top of the at least one wall part to a second state and re-assumes the first state with predetermined force removed, said shape-retentive stiffening element extending less than fully around the top opening.

* * * * *